United States Patent [19]

Heinzer et al.

[11] 4,056,045

[45] Nov. 1, 1977

[54] PRODUCTION OF BAGS FROM A PANEL OF SHEET MATERIAL

[75] Inventors: Hans Heinzer, Beringen; Werner Müller, Neuhausen am Rheinfall, both of Switzerland

[73] Assignee: S I G Schweizerische Industrie-Gesellschaft, Neuhausen am Rheinfall, Switzerland

[21] Appl. No.: 719,057

[22] Filed: Aug. 30, 1976

[30] Foreign Application Priority Data

Aug. 28, 1975 Switzerland ..... 11183/75

[51] Int. Cl.[2] ..... B31B 1/86

[52] U.S. Cl. ..... 93/35 SB

[58] Field of Search ..... 93/14, 18, 25–28, 93/35 R, 35 SB, 36.01, DIG. 1

[56] References Cited

U.S. PATENT DOCUMENTS 3,774,509 11/1973 Heinzer ..... 93/35 SB

*Primary Examiner*—Gerald A. Dost

*Attorney, Agent, or Firm*—Spencer & Kaye

[57] ABSTRACT

An elongate panel of a flexible sheet material which is not heat-sealable is formed into a succession of bags by advancing the panel in the direction of its length between a rectangular shaping tube and a folding box to form the panel into a tubular structure of rectangular cross section, applying a bead of adhesive material along one longitudinal edge of the panel and bringing the other longitudinal edge thereof against the adhesive to form a longitudinal seam, applying a bead of adhesive material to one narrow side and both wide sides of the tubular structure in the region defining the bottom of each bag to cause this bead to have the form of a U in a plane lying perpendicular to the length of the tubular structure, severing the tubular structure just downstream of each U-shaped bead, and forming the bottom of each bag by first folding in successive narrow sides of the tubular structure adjacent the associated line of severance, to give the wide sides the form of triangular ears each composed of two layers of sheet material, and then folding successive ears in against the folded narrow sides, the folded narrow sides being joined together, the layers of each ear being joined together, and the ears being joined to one another and to the folded narrow sides by respective portions of the U-shaped adhesive bead.

13 Claims, 15 Drawing Figures

3
1

2
B
12
8
5
19
20
23
11
17
13
4
16
9
6
23
10
22
22
A
7
21
17
18
25
29
25₁
29₂
25
27
26
28

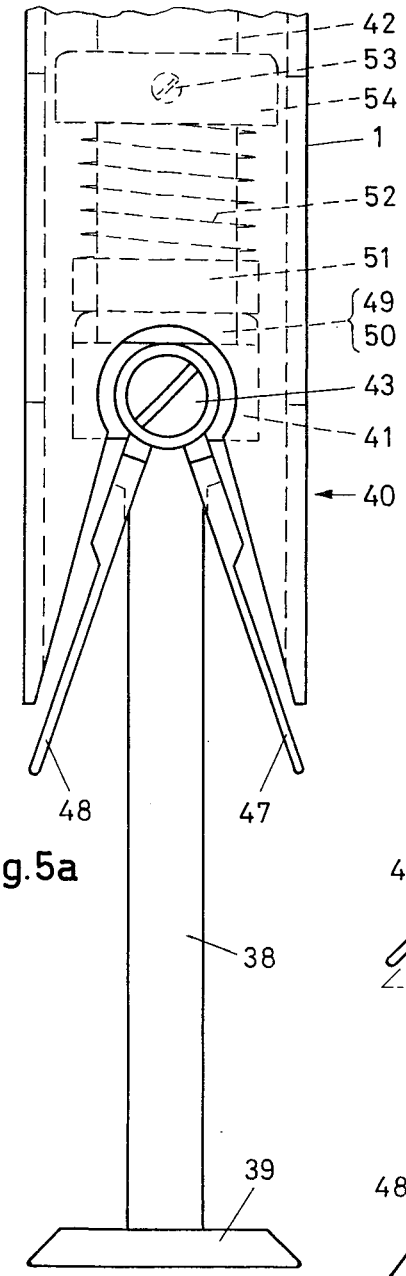
Fig.5a
Fig.5b
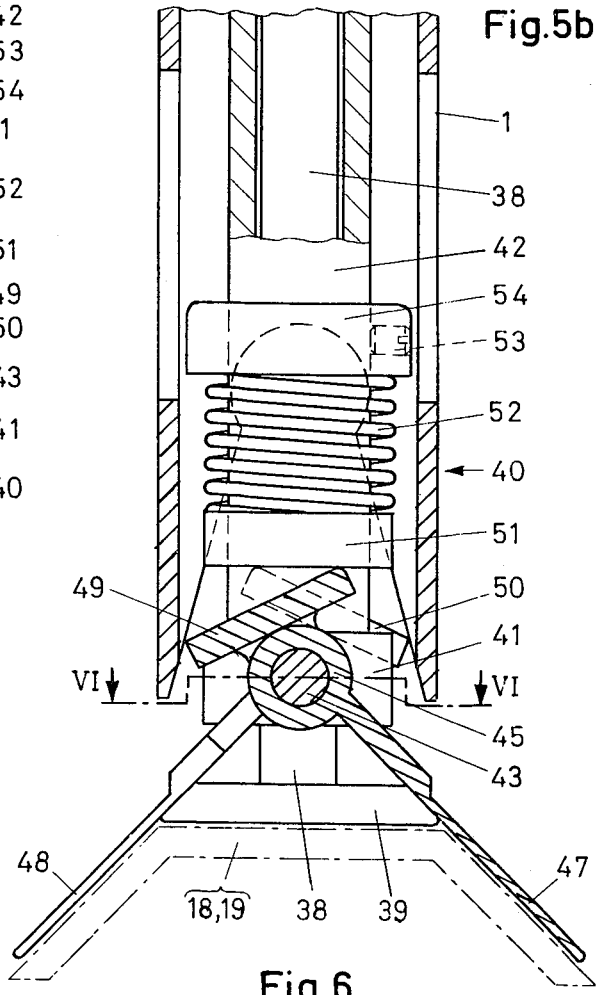
Fig.6
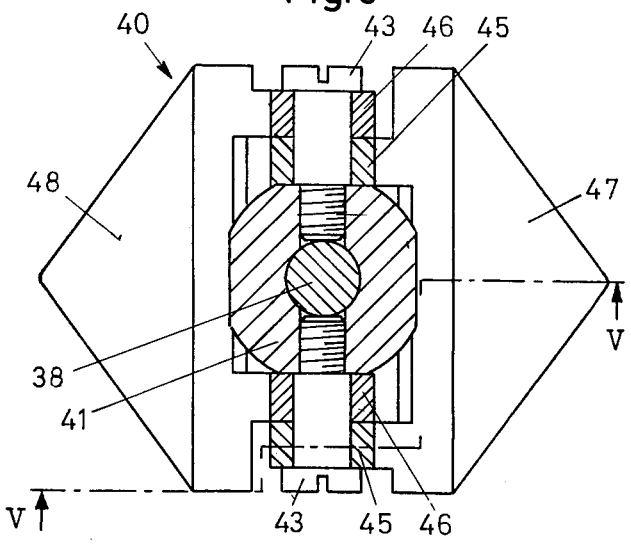

PRODUCTION OF BAGS FROM A PANEL OF SHEET MATERIAL

BACKGROUND OF THE INVENTION

The present invention relates to a method and apparatus for making bags from flexible sheet material. In a known method of this type, a panel of flexible sheet material is folded between a shaping tube and a folding box into a tubular structure of rectangular cross section and the two longitudinal edges of the panel are overlapped and connected together by a longitudinal seam. Then, a bottom is formed at the front end of the tubular structure and an end piece of that structure having such a bottom is severed from the remainder of the tubular structure to constitute a bag which is open at the top.

Apparatus which automatically carries out this process is disclosed in commonly-owned U.S. Pat. No. 3,774,509 and corresponding Swiss Pat. No. 542,701.

One drawback of this known method is that the bags must be made from a weldable or heat sealable sheet material. Such materials, however, are considerably more expensive than ordinary paper or the like.

SUMMARY OF THE INVENTION

It is therefore an object of the present invention to produce bags in a manner similar to that described above from inexpensive materials which are not weldable or heat sealable.

This and other objects are achieved according to the present invention by applying a bead of adhesive material to one longitudinal edge of the tubular structure as it is being formed and pressing the other longitudinal edge thereagainst to produce the longitudinal seam, temporarily halting the advance of the resulting tubular structure and applying a U-shaped pattern of adhesive material on the outer surface of one narrow side and two sides of the tubular structure and severing the structure ahead of the adhesive, and forming the bottom of a bag by folding the portions of the two narrow sides of the tubular structure adjacent the line of severance inwardly in succession so that they overlap and are attached to each other by the base portion of the U-shaped adhesive pattern, while at the same time producing ears at the portions of the two wide sides of the tubular structure adjacent the line of severance, each ear being composed of two layers of sheet material attached to each other by the portion of an arm of the U-shaped adhesive pattern near the base thereof, and subsequently folding the two ears down onto the connected narrow side portions so that they are attached thereto and to each other by the outer end portions of the arms of the adhesive pattern.

The present invention also relates to an apparatus for automatically performing this process. This apparatus includes: a nozzle which applies a stream of adhesive onto one longitudinal edge of the panel folded around the shaping tube; a longitudinal seam presser which presses the two longitudinal edges of the panel against one another to cause them to be fastened together by the thus applied bead of adhesive material; two nozzles which are movable transversely to the shaping tube and which operate when the thus formed tubular structure is at a standstill to apply a bead of adhesive to the outer surfaces of one narrow side and two wide sides, the bead forming a pattern in the shape of a U perpendicular to the length of the tubular structure; a scissors-type cutter disposed to sever the tubular structure just downstream of this adhesive pattern; four bottom folders mounted to operate in succession to fold first the end portions of the two narrow sides of the tubular structure, thereby forming the end portions of the wide sides into triangular ears each composed of two layers of sheet material attached to one another by means of portions of the U-shaped adhesive bead, and to then fold these ears against the folded end portions of the narrow sides, the end portions and the ears being folded down against a rectangular counter support attached at the outlet end of the shaping tube to a shaft movable in the shaping tube; and a dual gripper which grips the resulting bag bottom and pulls it into a carrier of a series of carriers which move in steps in a direction transverse to the shaping tube.

The present invention finally also relates to the bag produced according to the method of the present invention.

BRIEF DESCRIPTION OF THE DRAWINGS

FIG. 5*a* is an elevational view of a spreading mechanism of the apparatus of FIGS. 1 and 2, in a first operating position.

FIG. 5*b* is an elevational cross-sectional view, partly along the line V—V of FIG. 6 and in part in its plane of symmetry, of the spreading mechanism of FIG. 5*a* in a second operating position.

FIG. 6 is a cross-sectional view taken along line VI—VI of FIG. 5*b*.

DESCRIPTION OF THE PREFERRED EMBODIMENTS

Figure 1:
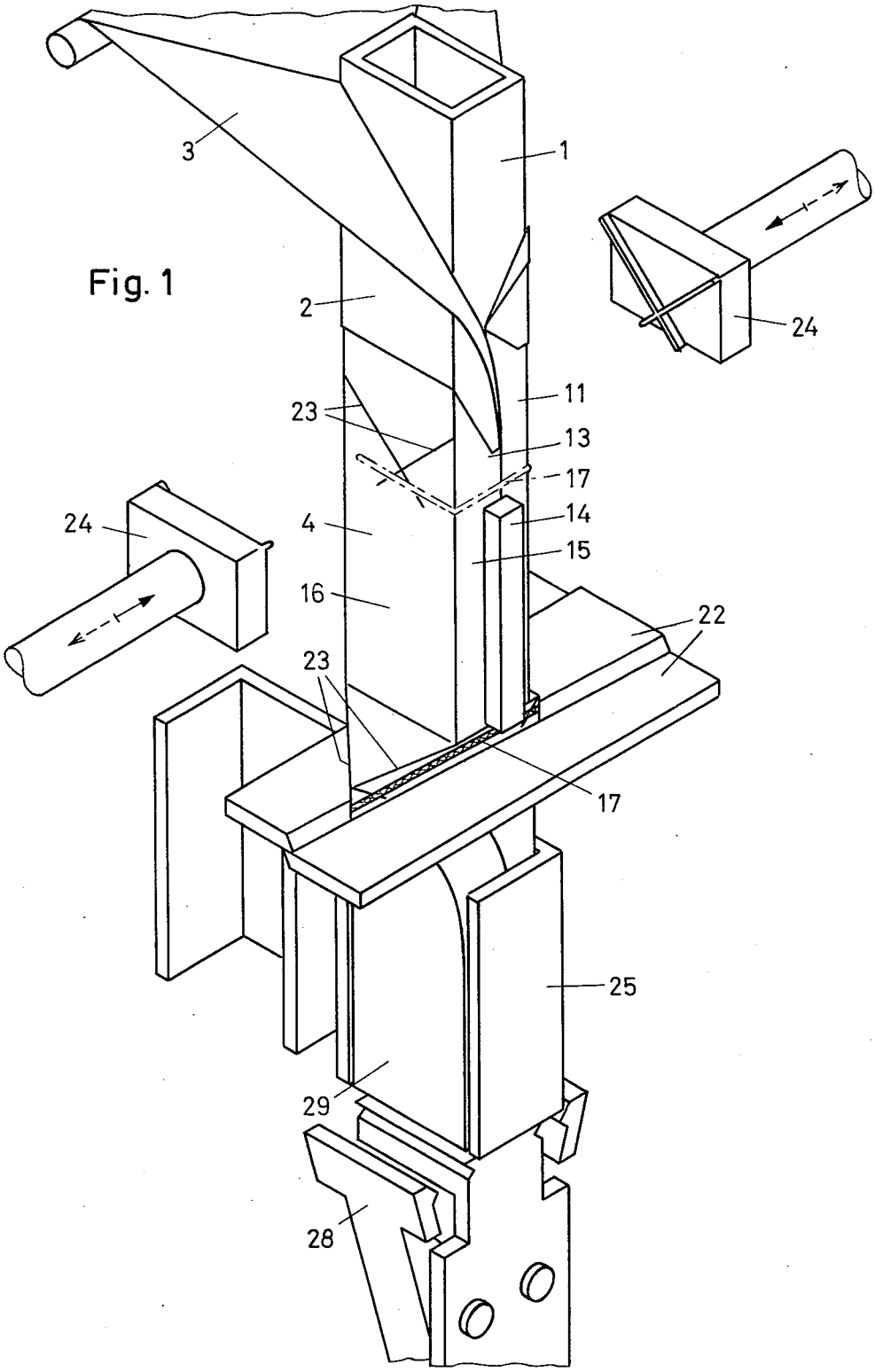
FIG. 1 is a perspective view of a folding box and several associated components of one embodiment of apparatus for producing bags according to the invention.
Figure 2:
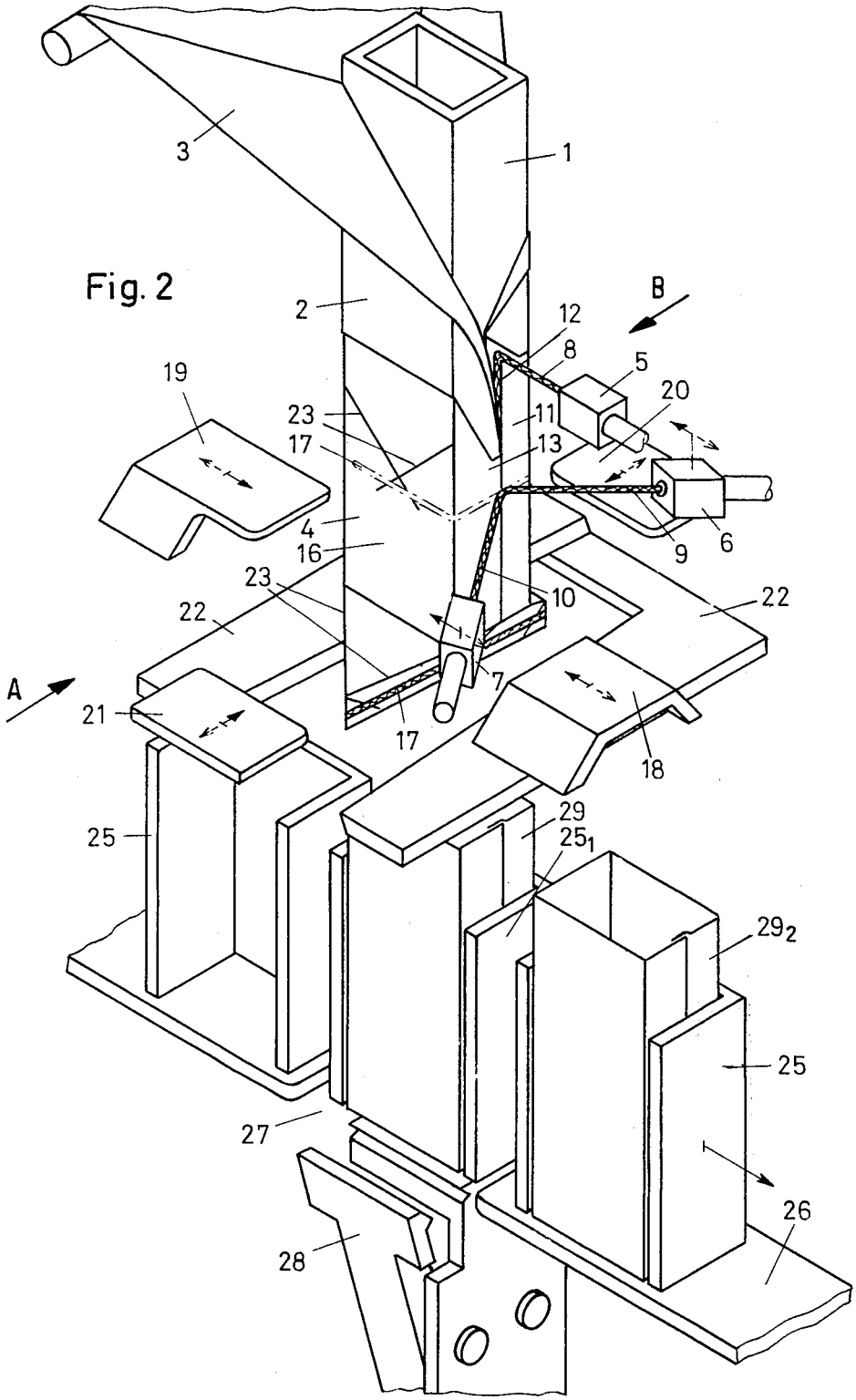
FIG. 2 is a perspective view in the same direction as that of FIG. 1 and showing other parts associated with the folding box of the embodiment of FIG. 1.

As shown in FIGS. 1 and 2, the illustrated apparatus includes a stationary vertical shaping tube 1 of rectangular cross section enclosed by a folding box 2 constituted by an appropriately shaped, bent sheet. A panel 3 of sheet material, e.g. thin paper, furnished by a supply roll (not shown) is pulled through between shaping tube 1 and folding box 2 and formed into a tubular structure 4 in a known manner. Individual bags are produced from this structure in a manner which will be described later.

In order to form the longitudinal seam in the tubular structure and to seal the bag bottoms, strips of adhesive are applied to the paper, for example by three nozzles 5, 6 and 7, as shown in FIG. 2, provided for this purpose and producing three streams 8, 9 and 10 of an adhesive, e.g. of the type known as "hot melt".

Nozzle 5 is stationary and operates only if the tubular structure 4 being formed is being pulled downwardly. The adhesive in stream 8 then forms a bead 12 on the outside of the one longitudinal edge 11 of panel 3 which has been folded around shaping tube 1 and the other longitudinal edge 13 of the panel comes to bear on this bead so that the two longitudinal edges 11 and 13 are attached to one another in an overlapping fashion under the pressure of a longitudinal seam presser 14, shown in FIG. 1.

Figure 3A:
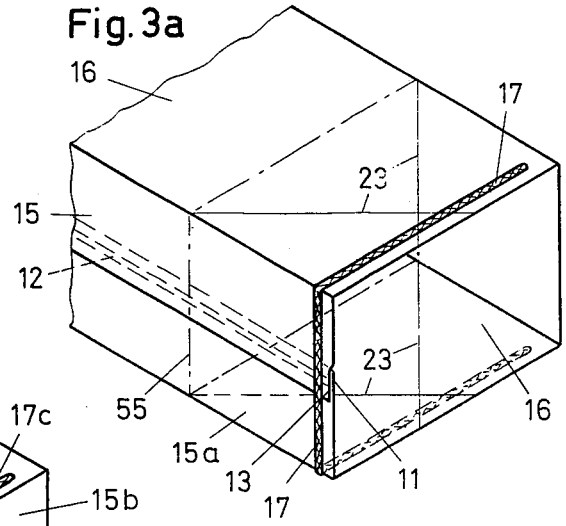
FIGS. 3*a* to 3*d* are perspective views showing four successive phases of the formation of a bag bottom according to the invention.

Nozzles 6 and 7, however, operate only when structure 4 is at a standstill and each nozzle moves from the position shown in FIG. 2 in the direction of the solid arrows. Thus two beads of adhesive are applied to the outer surfaces of one narrow side 15 and two wide sides 16 and these beads together form a U-shaped adhesive pattern 17 as shown in FIG. 3*a*, before the tubular structure is folded in this region to form the bag bottom. During advance of the tubular structure, the nozzles 6 and 7 are shut off and return to their starting positions, moving in the direction of the broken-line arrows.

Below the lower end of shaping tube 1, four bottom folders 18, 19, 20 and 21 are arranged and are connected to be moved in succession, each in the direction of its associated solid arrow, in order to form the bottom of a bag. For proper operation of the bottom folders 18–21, it is necessary to sever tubular structure 4 by means of a scissors-like cutter 22.

It is a considerable advantage to prestamp folding lines 23 into the wide sides 16, which is effected by means of two stamps 24 movable in the directions indicated by the associated arrows in FIG. 1, transverse to shaping tube 1, and disposed upstream of scissors 22 and longitudinal seam presser 14. These stamps 24 operate when tubular structure 4 is at a standstill.

A series of bag carriers 25 are disposed below scissors 22 so as to slide on a horizontal table 26, shown in FIG. 2, which is interrupted at 27 below shaping tube 1 to permit passage of a dual gripper 28 through the carrier $25_1$ then disposed below tube 1. Carrier $25_1$ is then supported by the two carriers 25 adjacent thereto since all carriers are connected together to form an endless chain which moves in steps in synchronism with the operating rhythm of the apparatus. Once carrier $25_1$ has received a bag 29 it carries it along in the direction of the arrow to stations constructed in a known manner for filling and closing bag 29. Carriers 25 may also be constituted by cardboard boxes in which bags 29 are packed to form liners.

Figure 4A:
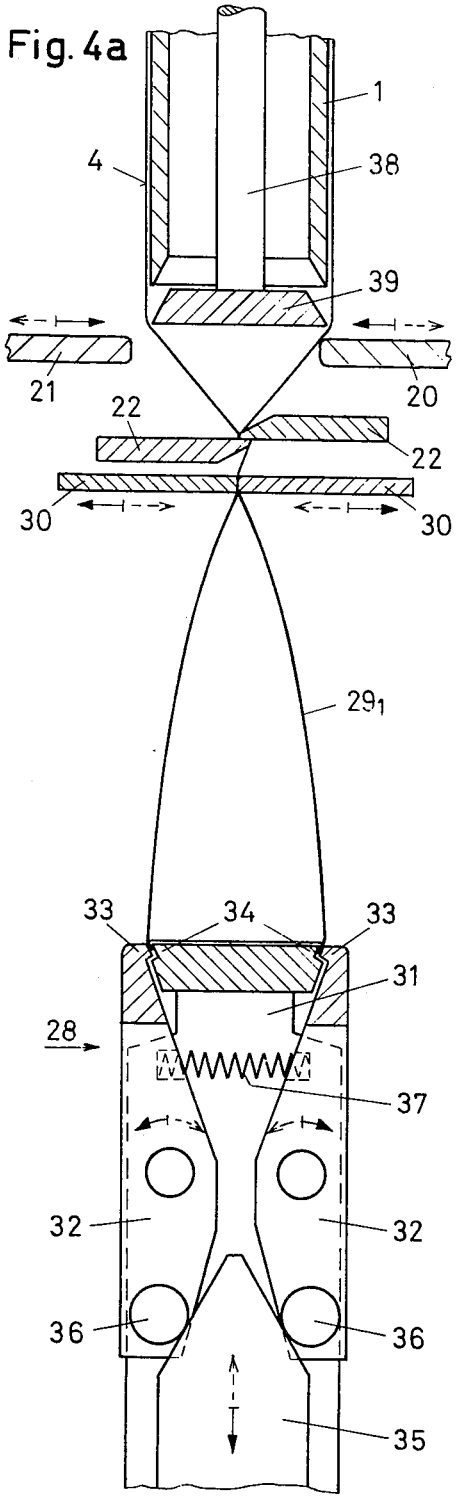
FIGS. 4*a* and 4*b* are elevational, cross-sectional views of two operating positions of a portion of the apparatus of FIGS. 1 and 2.

Referring to FIG. 4*a*, a pair of clamping jaws 30, not shown in FIGS. 1 and 2, is provided below scissors 22. There are also provided dual grippers 28 having levers 32 which are articulated in a known manner to an assembly plate 31 and which carry movable jaws 33 cooperating with jaws 34 fastened to plate 31. The operation of dual grippers 28 is controlled by a control wedge 35 which closes the pairs of jaws 33, 34 against a compression spring 37 when two cams 36 attached to levers 32 are driven apart. To aid the gripping operation, a shaft 38 is mounted to be movable up and down in the interior of shaping tube 1 and is provided at its lower end with a rectangular bottom stamp 39 serving as an abutment for bottom fold 18–21.

Figure 4B:
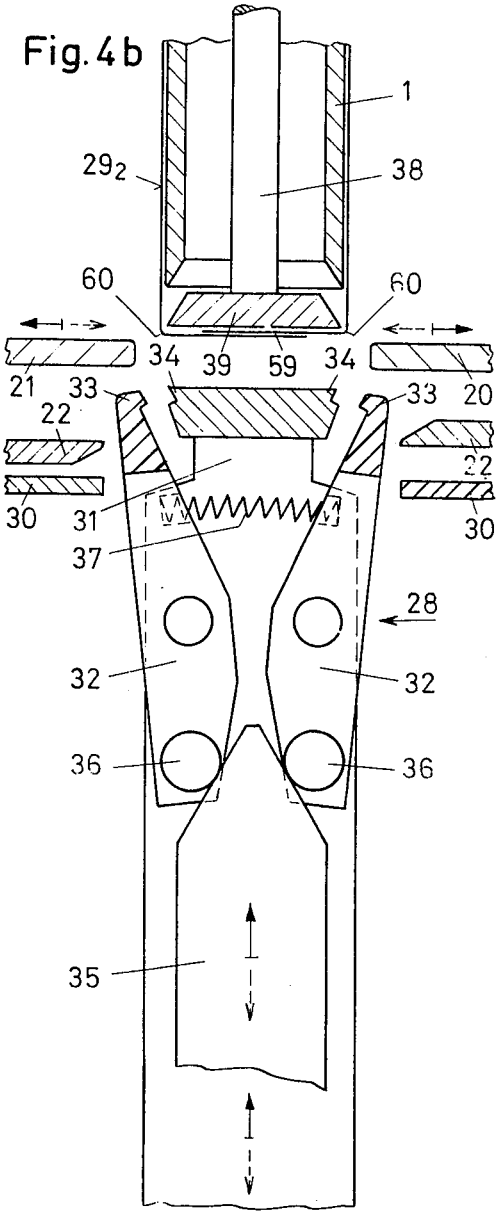

FIGS. 5*a*, 5*b* and 6 shows a spreading prefolder 40 provided in the region of the lower end of shaping tube 1, but not shown in FIGS. 4*a* and 4*b*. The spreading prefolder 40 includes a hinge member 41 fastened to the lower end of a control pipe 42 which can be moved up and down and which encloses the stamping shaft 38. Two hinge pins 43 are screwed into hinge body 41 and each pin 43 carries a respective member of each of two pairs of hinge eyes 45 and 46. Eyes 45 are part of a spreading arm 47, while eyes 46 are part of a second spreading arm 48.

Each of spreading arms 47 and 48 is permanently connected with a respective one of alignment plates 49 and 50. The alignment plates 49 and 50 cooperate with a pressure plate 51 which is displaceable on control pipe 42 and which is under the influence of a compression spring 52. Spring 52 is connected via its top to a setting ring 54 fastened to control pipe 42 by means of a screw 53.

When the bottom stamp 39 is disposed some distance below spreading arms 47 and 48, as shown in FIG. 5*a*, i.e. the control pipe 42 has been moved upwardly relative to stamping shaft 38, the alignment plates 49 and 50 are pressed into a horizontal position by pressure plate 51 to bring spreading arms 47 and 48 into their starting position where they subtend the smallest spread angle. If, however, upward movement of stamping shaft 38 brings bottom stamp 39 into a position between the spreading arms 47 and 48, the latter are spread apart until they finally take on the position of maximum spread shown in FIG. 5*b*.

In order to explain the operation of the above-described apparatus, reference is made to FIG. 4*a* in which a bag $29_1$ formed at the lower end of tubular structure 4 has been pulled down into carrier $25_1$, shown in FIG. 2, by means of dual grippers 28. Clamping jaws 30 have pressed tubular structures 4 flat with its narrow sides pressed together near the top of bag 29, so that scissors 22 can cut through it just above the clamping point but somewhat below the U-shaped adhesive pattern 17 of the bottom of the next-succeeding bag, as shown in FIG. 2. If after the clamping jaws 30 move apart to release the bag, the dual grippers 28 still move down somewhat, the top of bag $29_1$ will open automatically.

Now, spreading mechanism 40 is actuated so that it comes into its spread position shown in FIG. 5*b*, at which time arms 47 and 48 spread apart the two wide sides 16, in the region of the bottom of the next succeeding bag, and crease those sides along the prestamped folding lines 23. Then bottom side folders 18 and 19, shown in FIG. 2, are moved toward tubular structure 4 in succession and take on, one after the other, the position shown in dot-dash lines in FIG. 5*b*. The first side folder 18 folds one end piece 15*a* of the narrow side 15 which in FIGS. 3*a*–3*d* is the front narrow side, about a fold line 55 and against bottom stampe 39. At the same time edges $23_1$ are formed at the two oppositely disposed fold lines 23 in that parts of broadsides 16 come to rest on top of one another.

Figure 3B:
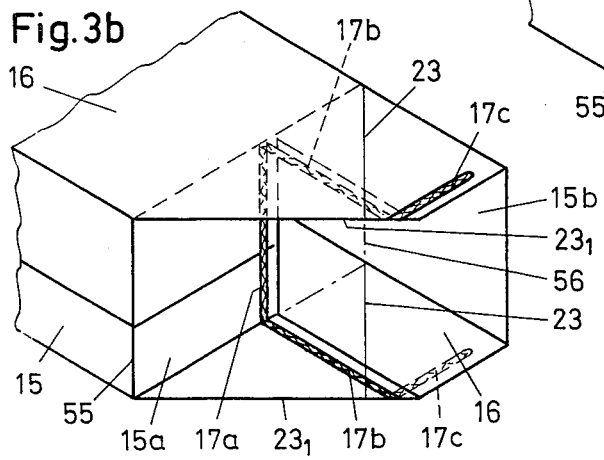

FIG. 3*a* shows the general configuration of the free end of structure 4 before the start of folding, while FIG. 3*b* shows the configuration of the free end after the operating stroke of the first side folder 18. Then the second side folder 19 executes a stroke to fold one end piece 15*b* of the rear narrow side 15 about a fold line 56 so that end piece 15*b* comes to overlap end piece 15*a* and is attached thereto by the base portion 17*a* of the U-shaped adhesive pattern. At the same time edges $23_2$ are formed at the other two oppositely disposed fold lines 23. The portions of each wide side 16 to either side of line $23_2$ which come to rest on top of one another are joined together by respective parts 17*b* of the arms of adhesive pattern 177 near the base 17*a.*

Figure 3C:
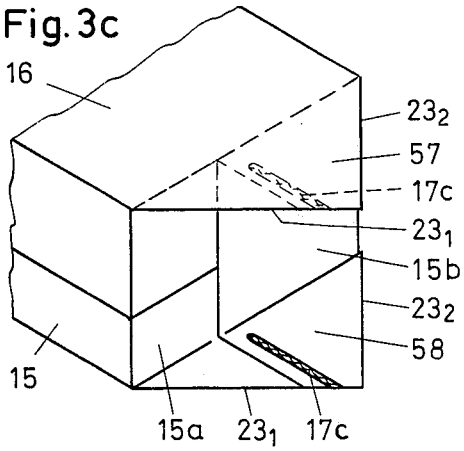
Figure 3D:
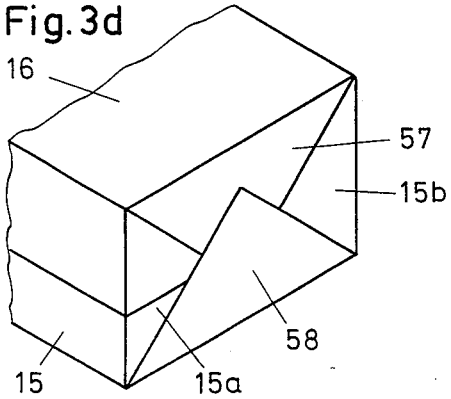

FIG. 3*c* shows the configuration after the operating stroke of the second side folder 19. It can be seen that two oppositely disposed triangular flaps, or ears, 57 and 58 have been formed. Each ear is composed of two attached layers of the end portions of its respective wide side 16 and each ear is provided on its inside surface with the outer end portion 17*c* of a respective arm of the adhesive pattern 17.

Then there are produced the operating strokes of first and second bottom ear folders 20 and 21 to fold ears 57 and 58 down against the end portions 15*a* and 15*b,* where they are attached to the latter by end portions 17*c* of the arms of adhesive pattern 17 to complete formation of the bag bottom.

As shown in FIG. 4*b,* when such bottom 59 of a new bag $29_2$ has been completed, it can be gripped by dual grippers 28. When the apparatus is in the operating position shown in FIG. 4*b,* the upper end of grippers 28 has already been inserted between the opened clamping jaws 30 and the blades of scissors 22 and has been pushed upwardly. If now dual grippers 28 are moved even further upwardly until their stationary jaws 34 press bottom 59 against the simultaneously somewhat raised bottom stamp 39, small downwardly protruding pleats are formed at the bottom edges 60 of the bag and these pleats are gripped by the closing pairs of jaws 33, 34 in order to pull new bag $29_2$ downwardly.

During the downward movement of dual grippers 28 required for this purpose, bottom stamp 39 moves downwardly with grippers 28 until the grippers reach the position shown in FIG. 4*a.* Then stamp 39 is moved upwardly, away from dual grippers 28, to return to its starting position shown in FIG. 4*a.* Thereafter clamping jaws 30 and scissors 22 and a new operating cycle begins.

In the illustrated embodiment of the present invention as shown in FIG. 2, nozzle 5 is stationary. It operates only if the tubular structure 4 being formed is moving downwardly. This produces the longitudinal bead 12 of adhesive on the outside of one longitudinal edge 11 of structure 4. The bead 12 could of course be produced just as well with a moving nozzle 5 and may be of advantage if it is important to have the adhesive applied as uniformly as possible. With simultaneous movement of the nozzle 5 and the paper panel 3 in respectively opposite directions, and corresponding sychronization of the two movements and adaptation of the ejection period, this requirement can be met to a substantial degree. The bead 12 can then be applied to the inner surface of the longitudinal edge forming the outside of the seam or, as shown, to the outer surface of the longitudinal edge forming the inside of the seam.

Figure 2A:
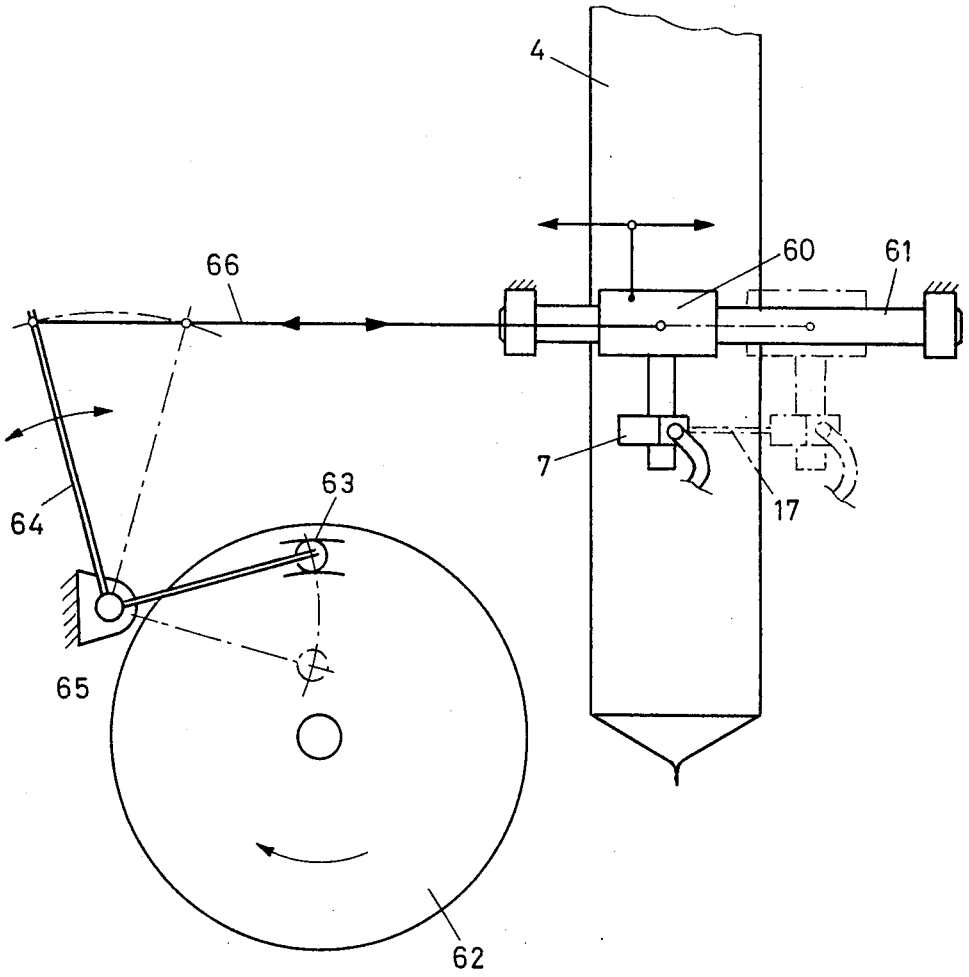
FIG. 2*a* is a schematic view of the drive means for operating the delivery nozzle which applies the adhesive bead of U-shaped configuration.

One embodiment of drive means for imparting movement of the above-described type to nozzle 7, for example, is shown in FIG. 2*a,* where this nozzle is fastened to a guide member 60 mounted for back and forth movement, in the direction of the associated double arrow, on a guide rail 61. The guide member 60 is driven by means of a cam disc 62 via a cam follower roller 63, a two-arm lever pivotally mounted at bearing 65 and having the free end of one arm fastened to follower 63, and a drive rod 66 connecting the free end of the other lever arm to the guide member 60. An identical structure can be provided for imparting suitable movement to nozzle 6.

Figure 2B:
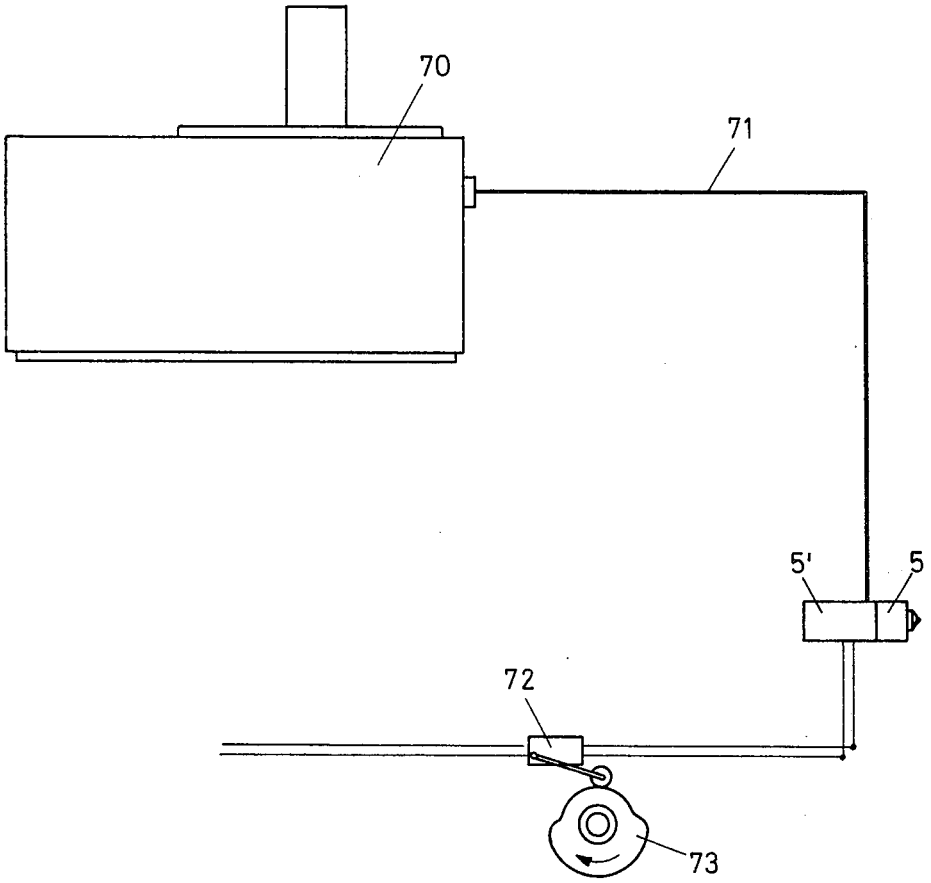
FIG. 2*b* shows a device for periodically activating the nozzle for producing a longitudinal adhesive band.

FIG. 2*b* is a schematic illustration of a suitable arrangement for controlling the delivery of adhesive to nozzle 5. Adhesive is delivered to nozzle 5 from a supply vessel 70 via a conduuit 71. The delivery of adhesive to the nozzle is controlled by an electrically actuated flow valve 5'. The delivery of actuating current to valve 5' is controlled by a switch 72 whose opening and closing is controlled by rotation of a cam disc 73 engaging a follower carried by the switch lever, cam disc 73 being rotated in synchronism with the operation of the entire machine. The delivery of adhesive to nozzles 6 and 7 can be controlled in precisely the same manner. When it is desired to improve the uniformity of the longitudinal bead 12, nozzle 5 can be arranged to undergo longitudinal movement by being mounted on the arrangement illustrated in FIG. 2*d.* This structure corresponds essentially to that illustrated in FIG. 2*a,* and corresponding components are given reference numerals corresponding to that of comparable components in the system illustrated in FIG. 2*a,* the corresponding components of FIG. 2*d* being identified with a prime. In the arrangement shown in FIG. 2*d,* nozzle 5 is mounted to undergo longitudinal movement, as opposed to the transverse movement of nozzles 6 and 7.

Figure 2C:
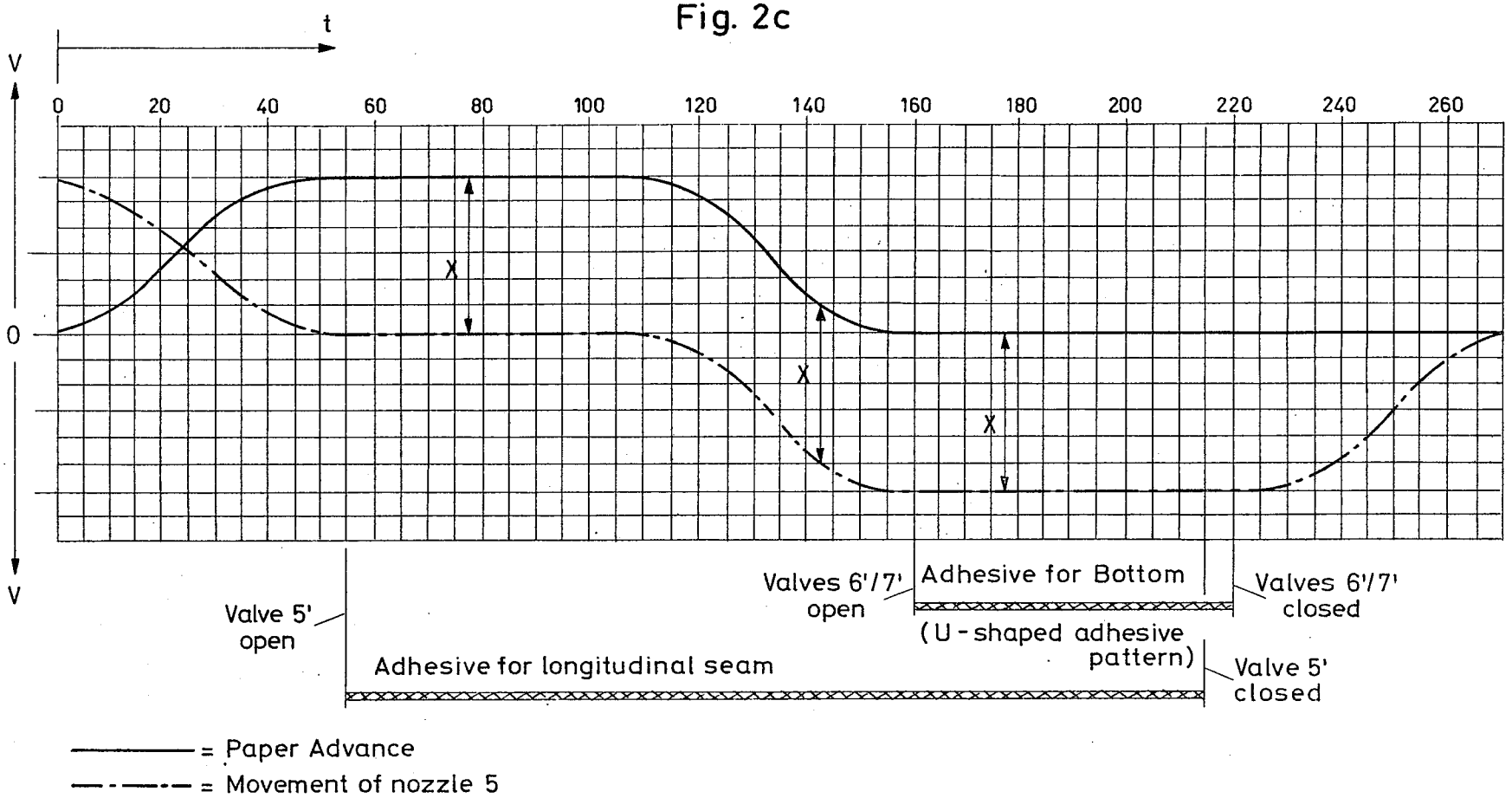
FIG. 2*c* is a diagram indicating the feed velocity of the adhesive material and the vertical movement of the nozzle for producing the longitudinal adhesive bead as a function of time.
Figure 2D:
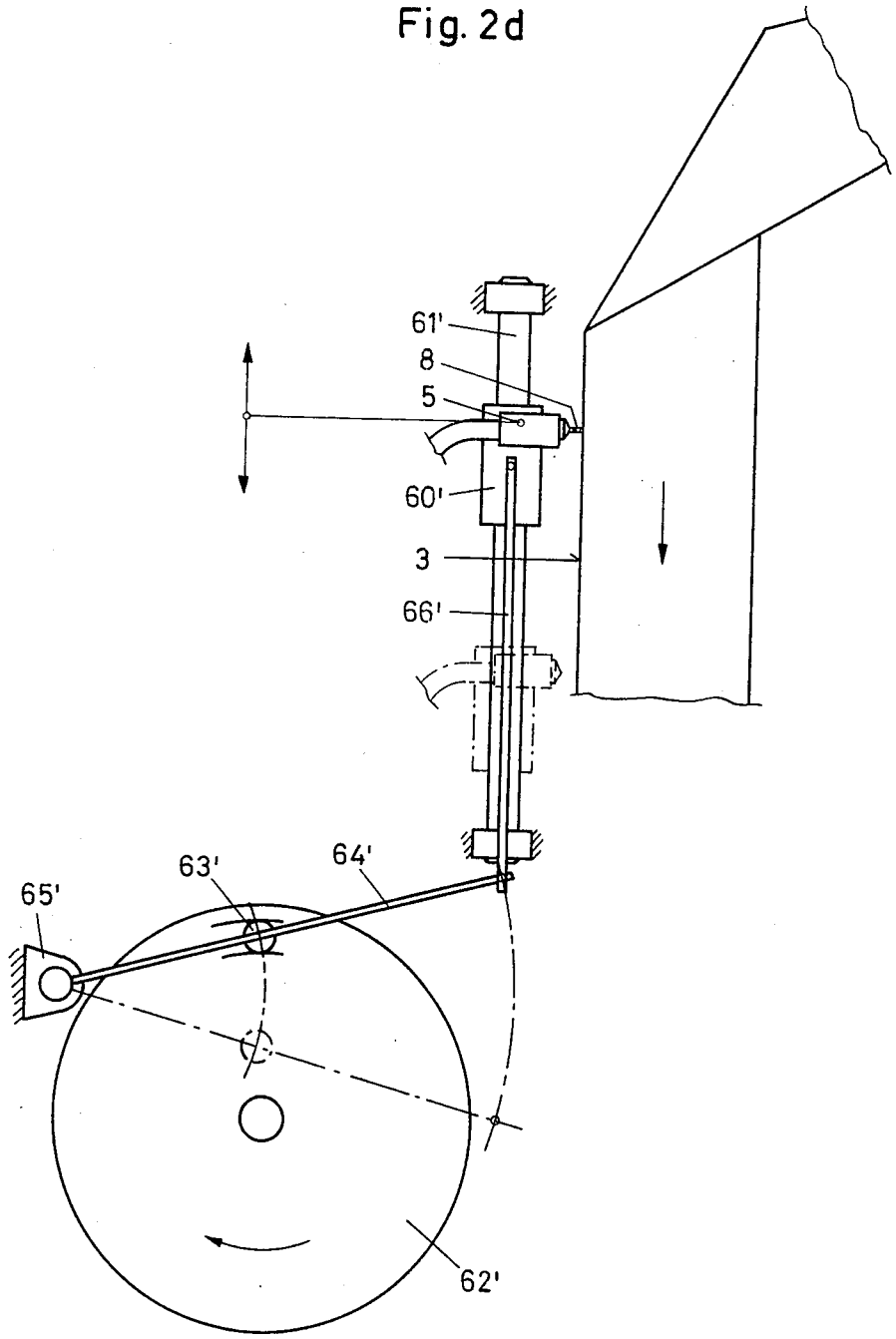
FIG. 2*d* is a schematic view of the drive means for the nozzle for applying the longitudinal adhesive bead.

FIG. 2*c* is a velocity vs. time diagram including a solid line curve depicting the velocity of advance of the paper tubular structure and a dot-dash line curve depicting the velocity of longitudinal movement of nozzle 5, both of these curves being with respect to time, or the machine operating cycle, represented in degrees. Also illustrated are the portions of each machine operating cycle during which adhesive is supplied by nozzles 5, 6 and 7. As can be seen, nozzle 5 begins delivering adhesive at a moment when the machine is in a position corresponding to 55° in its operating cycle, at which time the tubular structure is moving downwardly at a constant velocity and nozzle 5 is stationary. Between 110° and 160° in the machine operating cycle, the tubular structure is brought to a standstill, while nozzle 5 is accelerated in a manner such that its velocity relative to the tubular structure remains constant. After the tubular structure comes to a halt, nozzle 5 continues to move at a constant velocity, at least until termination of delivery of the adhesive stream thereform. Thus, a uniform longitudinal adhesive bead results. The constant relative velocity between the tubular structure and nozzle 5 is represented by the distance $x$ on the diagram. While panel 3 is at a standstill, adhesive is supplied by nozzles 6 and 7 during the time between 160° and 220° in the machine operating cycle.

It might finally be noted that the dual grippers 28 move in a manner depicted by the solid line curve in FIG. 2*c* in order to produce the desired movement of the tubular paper structure.

Although in practice bags will probably be always produced in a apparatus controlled to operate automatically, this is not absolutely in principle. Several process steps, e.g. the application of the adhesive, could also be performed manually for example by means of a brush. Also, individual components of the above-described apparatus, for example the bottom pleaters, could be replaced by manually operated members. The advantage of being able to produce bags from a very inexpensive foil, e.g. paper, would still be present.

Whether all or part of the apparatus is to operate automatically, the synchronized movement of those components which are to operate automatically can be effected and controlled by drive mechanisms designed according to principles well known in the art.

It will be understood that the above description of the present invention is susceptible to various modifications, changes and adaptations, and the same are intended to be comprehended within the meaning and range of equivalents of the appended claims.

We claim:

1. In a method for producing bags in succession from an elongate panel of flexible sheet material having parallel longitudinal edges, which method includes: advancing the panel in the direction of its length between a shaping tube having a rectangular cross section and extending in the direction of panel advance and a folding box surrounding a portion of the length of the shaping tube, to fold the panel into a tubular structure of rectangular cross section with the longitudinal edges of the panel overlapping; joining the longitudinal edges of the panel together to form a longitudinal seam of the tubular structure; forming a closed bottom at the leading end of the tubular structure, which is the leading end with respect to the direction of advance of the panel; and severing a portion of the tubular structure having such closed bottom to provide a bag which is open at its top and to establish a new leading end of the tubular structure at the plane of severance, the improvement wherein:

said step of joining the longitudinal edges of the panel together comprises applying a longitudinal bead of adhesive material along one of the longitudinal edges and then pressing the other longitudinal edge against that bead to form the longitudinal seam; and said step of forming a closed bottom comprises: applying adhesive to the outer surface of one narrow side and both wide sides of the tubular structure, while the structure is stationary, to form a transverse adhesive bead having a U-shaped configuration in a plane perpendicular to the length of the tubular structure and located in a region of the tubular structure at which a closed bottom is to be formed; and, in sequence, folding a portion of the one narrow side at the leading end of the tubular structure inwardly to lie in a plane perpendicular to the length of the tubular structure, folding a corresponding portion of the other narrow end inwardly to lie in the same plane as the folded portion of the one narrow side, to cause the other narrow side to contact the base of the U-shape defined by the transverse adhesive bead and to be attached thereby to the one narrow side, said steps of folding the narrow sides imparting to the corresponding portions of the wide sides of the tubular structure the form of ears each composed of two layers of sheet material, the layers of each ear being fastened together by a portion of a respective arm of the U-shape defined by the transverse adhesive bead, and folding the ears in succession against the folded narrow side portions in a manner to cause the ears to be fastened together and to the folded narrow side portions by the end portions of the arms of the U-shape defined by the transverse adhesion bead.

2. A bag produced by the method defined in claim 1.

3. In apparatus for automatically producing bags in succession from an elongate panel of flexible sheet material having parallel longitudinal edges, which apparatus includes means for forming such panel into a tubular structure of rectangular cross section which extends in the direction of the length of the panel with its longitudinal edges overlapping, means for fastening the longitudinal edges together to form a longitudinal seam in the tubular structure, means for advancing the tubular structure in the direction of its length, means for joining the sides of the tubular structure together, at the leading end thereof, to form a closed bag bottom, and means for severing a portion of the tubular structure having such closed bottom to provide a bag which is open at the top and to establish a new leading end of the tubular structure at the plane of severance, the improvement wherein:

said means for fastening comprise means including a first delivery nozzle for delivering a stream of adhesive onto one of the longitudinal edges of the panel to form a bead of adhesive extending along that edge, and means for pressing the other longitudinal edge of the panel against that adhesive for fastening the longitudinal edges together;

said means for joining the sides of the tubular structure comprise means including two second delivery nozzles mounted for movement transverse to the length of the tubular structure for delivering streams of adhesive onto the outer surface of one narrow side and both wide sides to form an adhesive pattern having a U-shaped configuration in a plane perpendicular to the length of the tubular structure and located in a region of the tubular structure at which a closed bottom is to be formed; and said means for severing comprise a scissors-type cutter located for severing the tubular structure along a plane just downstream of the U-shaped adhesive pattern, with respect to the direction of advance of the tubular structure.

4. An arrangement as defined in claim 3 further comprising stamping means located upstream of said cutter, relative to the direction of advance of the tubular structure, and movable transversely to the length of the tubular structure for stamping the wide sides of the structure with creases which define lines along which those sides are folded during forming of a bag bottom.

5. An arrangement as defined in claim 4 wherein said means for joining the sides of the tubular structure together comprise: a shaft associated with said means for forming such panel into a tubular structure and extending parallel to the direction of advance of the tubular structure; a bottom stamper carried at the end of said shaft to be positioned adjacent the location of the leading end of the tubular structure for presenting a counter surface against which portions of the sides of the tubular structure adjacent the leading end thereof can be pressed to permit formation of a closed bag bottom; a spreading prefolder having two laterally movable spreading arms for spreading the wide sides of the tubular structure adjacent the leading end thereof to aid the folding of the wide sides during formation of a closed bag bottom; and a control tube enclosing said shaft, carrying said spreading arms, and movable parallel to the direction of advance of the tubular structure for moving said prefolder relative to said bottom stamper to control the lateral position of said spreading arms.

6. An arrangement as defined in claim 5 wherein: said prefolder further comprises pivot means mounted at one end of said control tube and supporting said spreading arms for pivotal movement about an axis parallel to the planes defining the locations of the wide sides of the tubular structure between a retracted position in which said spreading arms subtend a minimum angle and a spread position in which said spreading arms subtend a maximum angle for spreading the wide sides of the tubular structure, and spreading arm control means resiliently connected to said prefolder for resiliently urging said spreading arms into their retracted position; and said shaft is movable relative to, and parallel to the length of, said control tube and said bottom stamper is formed to act on said spreading arms for causing said bottom stamper to move said spreading arms to their spread position when said shaft is moved to a predetermined longitudinal position relative to said control tube.

7. An arrangement as defined in claim 6 wherein said control means comprise: an annular member mounted on said control tube for longitudinal movement relative thereto; and a compression ring having one end fastened to said control tube and its other end fastened to said annular member for resiliently urging said annular member against said spreading arms.

8. An arrangement as defined in claim 3 further comprising stamping means located upstream of said cutter, relative to the direction of advance of the tubular structure, and movable transversely to the length of the tubular structure for stamping the wide sides of the structure creases which define lines along which those sides are folded during forming of a bag bottom.

9. An arrangemment as defined in claim 8 wherein said means for joining the sides of the tubular structure together comprise: a shaft associated with said means for forming such panel into a tubular structure and extending parallel to the direction of advance of the tubular structure; a bottom stamper carried at the end of said shaft to be positioned adjacent the location of the leading end of the tubular structure for presenting a counter surface against which portions of the sides of the tubular structure adjacent the leading end thereof can be pressed to permit formation of a closed bag bottom; a spreading prefolder having two laterally movable spreading arms for spreading the wide sides of the tubular structure adjacent the leading end thereof to aid the folding of the wide sides during formation of a closed bag bottom; and a control tube enclosing said shaft, carrying said spreading arms, and movable parallel to the direction of advance of the tubular structure for moving said prefolder relative to said bottom stamper to control the lateral position of said spreading arms.

10. An arrangement as defined in claim 9 wherein: said prefolder further comprises pivot means mounted at one end of said control tube and supporting said spreading arms for pivotal movement about an axis parallel to the planes defining the locations of the wide sides of the tubular structure between a retracted position in which said spreading arms subtend a minimum angle and a spread position in which said spreading arms subtend a maximum angle for spreading the wide sides of the tubular structure, and spreading arm control means resiliently connected to said prefolder for resiliently urging said spreading arms into their retracted position; and said shaft is movable relative to, and parallel to the length of, said control tube and said bottom stamper is formed to act on said spreading arms for causing said bottom stamper to move said spreading arms to their spread position when said shaft is moved to a predetermined longitudinal position relative to said control tube.

11. An arrangement as defined in claim 3 further comprising means defining a pair of clamping jaws presenting straight parallel clamping surfaces located downstream of said cutter relative to the direction of advance of the tubular structure for clamping the tubular structure to give it a flat configuration at the location of, and during, operation of said cutter.

12. An arrangement as defined in claim 3 wherein said first delivery nozzle is mounted to be stationary relative to said means for forming such panel and is arranged to deliver a stream of adhesive during the times when said means for advancing are active to advance the tubular structure.

13. An arrangement as defined in claim 3 wherein said first delivery nozzle is mounted to be displaced relative to said means for forming in the direction opposite to the direction in which said advancing means advance the tubular structure, the movements of said first nozzle and the tubular structure, and the delivery of adhesive by said first nozzle, being related to make the resulting bead of adhesive uniform.

* * * * *